US010392236B2

(12) United States Patent
Fordice et al.

(10) Patent No.: US 10,392,236 B2
(45) Date of Patent: Aug. 27, 2019

(54) STRING REELS WITH LEVEL WIND APPARATUS

(71) Applicant: The Boeing Company, Chicago, IL (US)

(72) Inventors: Robert Fordice, Shoreline, WA (US); Shawn A. McAuley, Sammamish, WA (US); Craig Ericksen, Renton, WA (US); Jourdon S. Abrams, Everett, WA (US)

(73) Assignee: The Boeing Company, Chicago, IL (US)

( * ) Notice: Subject to any disclaimer, the term of this patent is extended or adjusted under 35 U.S.C. 154(b) by 228 days.

(21) Appl. No.: 15/467,671

(22) Filed: Mar. 23, 2017

(65) Prior Publication Data

US 2018/0273340 A1 Sep. 27, 2018

(51) Int. Cl.
*B66D 1/50* (2006.01)
*B66D 1/38* (2006.01)

(52) U.S. Cl.
CPC ..... *B66D 1/50* (2013.01); *B66D 1/38* (2013.01)

(58) Field of Classification Search
CPC ..... B66D 1/38; B66D 1/50; B65H 75/4407; B65H 75/4486
See application file for complete search history.

(56) References Cited

U.S. PATENT DOCUMENTS 4,227,678 A * 10/1980 Laky ..... B66D 1/50 242/390.2
2005/0087644 A1* 4/2005 Kim ..... B65H 75/425 242/390.8
2012/0048152 A1* 3/2012 Kim ..... B66D 1/39 108/20
2018/0044151 A1* 2/2018 Hall ..... B66D 1/38

* cited by examiner

*Primary Examiner* — William E Dondero
(74) *Attorney, Agent, or Firm* — Hanley, Flight & Zimmerman, LLC

(57) ABSTRACT

Example string reels with level wind apparatus are disclosed herein. An example level wind apparatus includes a guide to direct a line onto or away from a reel when the reel is rotating. The reel is rotatable in a first direction to wind the line onto the reel and the reel is rotatable in a second direction to unwind the line from the reel. The level wind apparatus also includes a tensioner to create tension in the line while the reel is rotating the second direction.

19 Claims, 6 Drawing Sheets

STRING REELS WITH LEVEL WIND APPARATUS

FIELD OF THE DISCLOSURE

This disclosure relates generally to string reels and, more particularly, to string reels with level wind apparatus.

BACKGROUND

String reels may be used to deliver or retract a line such as a rope, a cable, etc. String reels include a reel or drum that rotates in one direction to wind the line around the reel and rotates in the other direction to unwind the line from the reel. String reels may be used as hoists to move (e.g., lift) an object. For instance, the line may be coupled to an object, and the reel may be operated in one direction or the other direction to move the object accordingly. String reels may also be used as positioning equipment to lift an article to a height, and manipulate, or position, the article in a precise manner. Lifting may be accomplished with controlled movement and rigging with a two or more reels attached.

SUMMARY

An example level wind apparatus disclosed herein includes a guide to direct a line onto or away from a reel when the reel is rotating. The reel is rotatable in a first direction to wind the line onto the reel and the reel is rotatable in a second direction to unwind the line from the reel. The example level wind apparatus also includes a tensioner to create tension in the line while the reel is rotating the second direction.

An example string reel disclosed herein includes a reel that is rotatable in a first direction to wind a line onto the reel and rotatable in a second direction to unwind the line from the reel. The example string reel also includes a level wind apparatus to direct the line onto or away from the reel when the reel is rotating. The level wind apparatus is movable along a circumference of the reel from a first position to a second position.

An example string reel disclosed herein includes a reel around which a line is to be wound and unwound. The reel is rotatable about a first axis. The example string reel also includes a wheel disposed adjacent the reel. The wheel is rotatable about a second axis parallel to the first axis. The line is engaged with the wheel and the wheel is to rotate in a same direction as the reel when unwinding the line to cause a tension in the line between the reel and the wheel.

Figure 1:
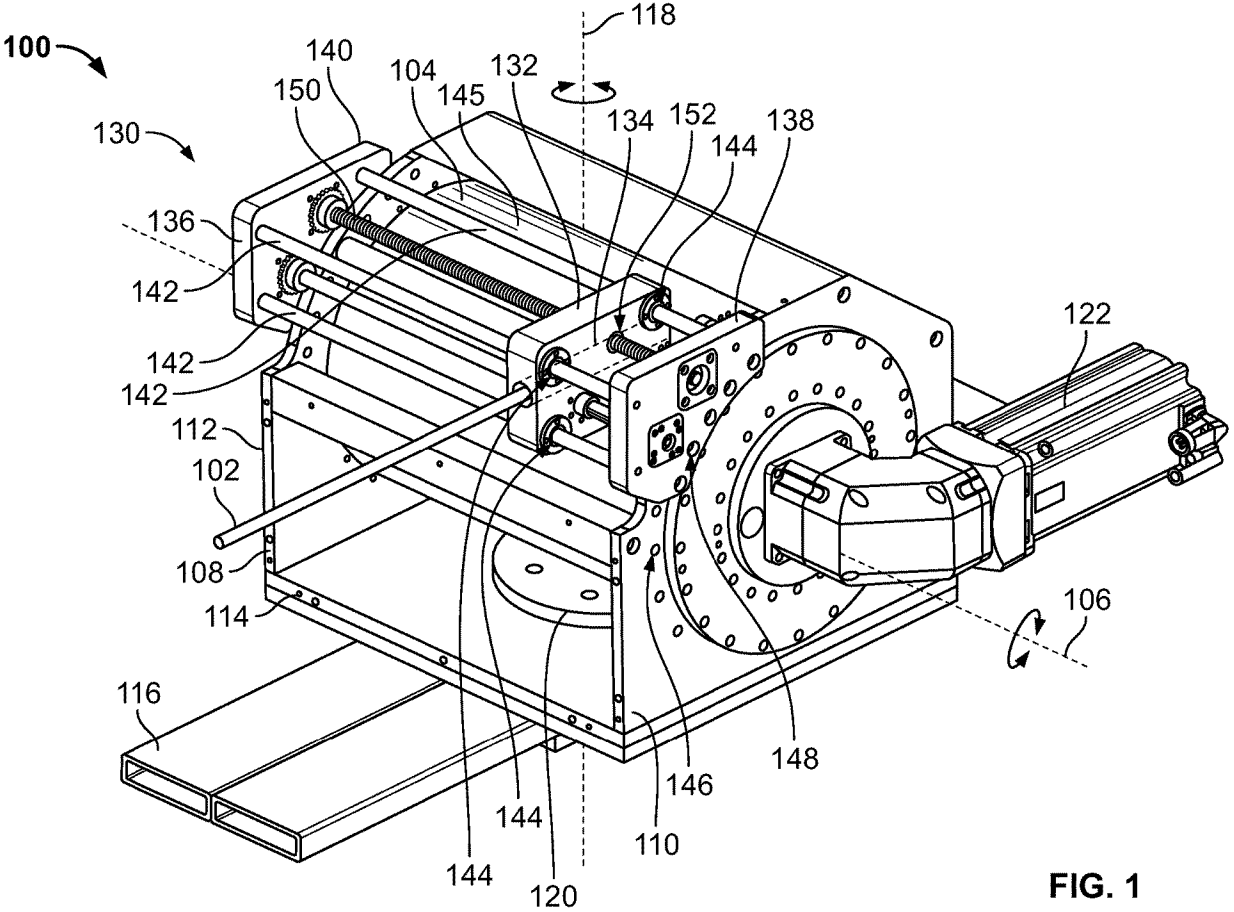
FIG. 1 is a perspective view of an example string reel constructed in accordance with one or more principles of this disclosure.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

DETAILED DESCRIPTION

Example string reels are disclosed herein. The example string reels may be used as hoists to move an object, such as a vehicle. For example, a line may be coupled to an object, and the reel may be rotated to retract or deliver the line and, thus, to move the object in one direction or another. As used herein, the term "line" means any structure that can be wound around a reel and which can support a load in tension such as, for example, a fibrous rope or string, a wire, a cable (e.g., a steel cable), etc.

An example string reel disclosed herein includes a level wind apparatus that directs a line onto or away from the reel when the reel is rotating. The level wind apparatus may be used to evenly distribute the line along the reel circumference and/or control the direction of the line onto the reel. In some examples, the level wind apparatus includes a guide with a passageway through which the line passes. The guide is movable along a length of the reel to distribute the line along the reel when the reel is retracting the line. As such, the example level wind apparatus helps to keep the line uniformly distributed and untangled on the reel. Likewise, the guide may move along the length of the reel when the reel is delivering the line to help direct the line away from the reel.

In some examples, the level wind apparatus is movable along a circumference (a parallel circumference) of the reel to direct the line in different directions. For example, the level wind apparatus may be moved from a first position where the line is directed in a substantially horizontal direction to a second position where the line is directed in a substantially vertical direction. As a result, the direction of the line coming off of or onto the reel can be easily changed without having to reposition the entire string reel.

Example level wind apparatus disclosed herein include a unique tensioner. The tensioner creates tension in the line as the reel is unwinding or delivering the line. This tension helps prevent slack from accumulating between the reel and the guide, which may otherwise jam or negatively impact the moving parts of the string reel. The tensioner operates to drive the line away from the reel when unwinding the line and freewheels or allows the line to slide over the tensioner when retracting or winding the line on the reel. In some examples, the tensioner includes a friction wheel that is engaged with the line. When the reel is rotating to unwind the line, the friction wheel rotates and pulls the line away from the reel, thereby creating a tension in the line that prevents slack buildup. In some examples, the friction wheel is rotated slightly faster than the reel to maintain tension in the line. When the reel is rotating to wind the line back onto the reel, the friction wheel may freewheel (rotate freely), which allows the line to slide over the friction wheel without creating additional tension in the line. In some examples, the friction wheel is switched between driving the line and freewheeling via a clutch (e.g., a sprag clutch).

In some examples, the reel is substantially smooth and does not have grooves for the line. Known string reels include a groove in the reel for the line to lay when being wound onto the reel. Thus, such known reels are configured for use with a line having a particular diameter or size. Unlike these known string reels, the example string reels disclosed herein can be used with lines having different sizes. For instance, different diameter lines can be used in the same string reel (e.g., a line with a first diameter can be replaced with a line having a second diameter). Thus, the example string reels can be utilized in more applications.

FIG. 1 illustrates an example string reel 100 (also referred to as a string reel based mounted hoist) constructed in accordance with one or more principles of this disclosure. The example string reel 100 winds or unwinds a line 102 from a reel 104 (e.g., a drum, a wheel, etc.). The line 102 may be a rope, a cable (e.g., a steel cable), etc. The line 102 may be connected to an object (e.g., a vehicle) that is to be moved (e.g., lifted). In some examples, the string reel 100 may be used hoist an object off the ground. For example, the line 102 may be redirected downward (e.g., via a pulley) to lift or lower the object relative to the ground, an example of which is discussed in further detail in connection with FIGS. 5 and 6. In other examples, the string reel 100 may be used to move the object from side-to-side and/or any other direction. The reel 104 rotates in one direction (e.g., a first direction) to wind the line 102 around the reel 104 (e.g., to lift and/or otherwise move the object in one direction) and rotates in the opposite direction (e.g., a second direction) to unwind the line 102 from the reel 104 (e.g., to allow the object to be lowered and/or otherwise move the object in another direction).

In the illustrated example, the reel 104 is rotatable about a rotational axis 106. In the illustrated example, the rotational axis 106 is substantially horizontal. However, in other examples, the reel 104 may be oriented differently and the rotational axis 106 may be at other orientations or angles. In the illustrated example, the reel 104 is supported by a frame 108 having a first support plate 110, a second support plate 112 and a base support plate 114. The first and second support plates 110, 112 are parallel and spaced apart from each other and extend perpendicularly from the base support plate 114. The reel 104 is rotatably coupled between the first support plate 110 and the second support plate 112 and spaced apart from the base support plate 114. In other examples, the frame 108 may have more or fewer support plates to support the reel 104.

The frame 108 may be coupled to any structure to support the string reel 100. In FIG. 1, the base support plate 114 is coupled to a support bar 116. In some examples, the string reel 100 is rotatable about an axis 118 (e.g., the vertical axis, depending on the orientation of the string reel 100) that is perpendicular to the rotational axis 106. For example, in the illustrated example of FIG. 1, the frame 108 is rotatably coupled to the support beam via a swivel mount 120. As such, the string reel 100 can rotate about the axis 118 to point the line 102 in other radial directions. In other examples, the frame 108 may be non-rotatably coupled to the support bar 116.

To rotate the reel 104 in one direction or the other, the example string reel 100 includes a motor 122. In the illustrated example, the motor 122 is coupled to the first support plate 110. The motor 122 may be activated to rotate the reel 104 in one direction to wind the line 102 onto the reel 104 and activated to rotate the reel 104 in the opposite direction to unwind the line 102 from the reel 104.

Figure 2:
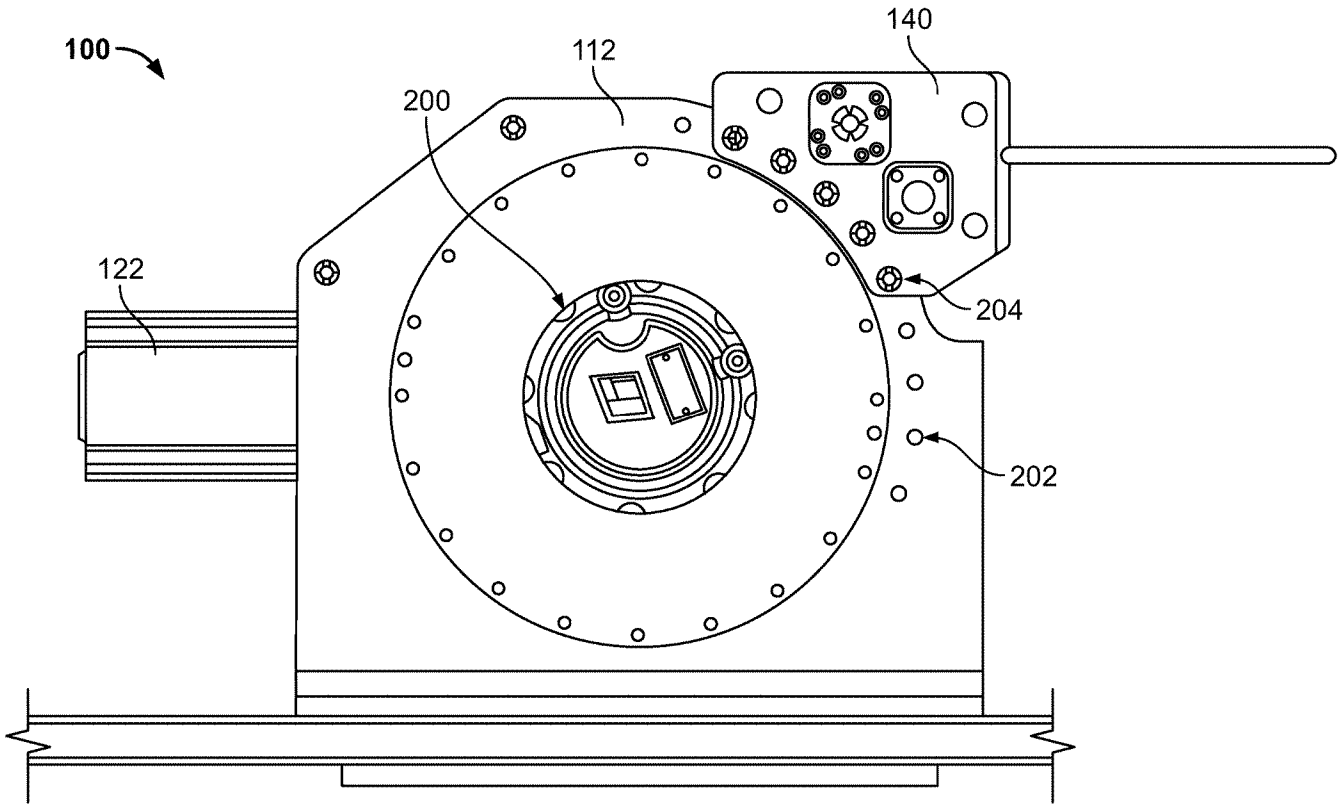
FIG. 2 is a side view of the example string reel of FIG. 1.

FIG. 2 is a side view of the example string reel 100 looking at the second support plate 112. In some examples, a gear system 200 is used to transfer rotational motion from the motor 122 to the reel 104 (FIG. 1). In the illustrated example, the gear system 200 is disposed within the reel 104, which results in a more compact arrangement. In some examples, the gear system 200 is a planetary gear system. In other examples, other types of gear systems or gear trains may be implemented, which may be disposed inside and/or outside of the reel 104. In some examples, a brake is also implemented in the reel 104.

Referring back to FIG. 1, the string reel 100 includes an example level wind apparatus 130 that guides the line 102 onto or off of the reel 104 (depending on the direction of rotation). In the illustrated example, the level wind apparatus 130 includes a guide 132 having a passageway 134 (shown in dashed lines) through which the line 102 passes. In the illustrated example, the guide 132 is positioned such that the passageway 134 points the line 102 in a direction that is tangential to the reel 104. In the illustrated example, the guide 132 directs the line 102 in a substantially horizontal direction. However, in other examples, the string reel 100 may be positioned differently to point the guide 132 in other directions (e.g., vertically downward). In some examples, the level wind apparatus 130 is movable to redirect the line 102 as disclosed in further detail herein.

To distribute the line 102 along the reel 104, the guide 132 is movable back-and-forth (e.g., translates) across the length of the reel 104. For example, in the illustrated example of FIG. 1, the level wind apparatus 130 includes a carriage 136 having a first end plate 138 and a second end plate 140 spaced apart from the first end plate 138. In the illustrated example, the first end plate 138 is coupled to the first support plate 110 of the frame 108 and the second end plate 140 is coupled to the second support plate 112 of the frame 108. The carriage 136 include linear guide tracks 142 extending between the first and second end plates 138, 140. In the illustrated example, the linear guide tracks 142 are linear guide rods or shafts adjacent the reel 104 along which the guide 132 can slide or translate back-and-forth along the length of the reel 104 (e.g., along an axis that is parallel to and offset from the axis 118) between the first support plate 110 and the second support plate 112. Each of the linear guide tracks 142 extends through a respective opening 144 in the guide 132. In some examples, linear bearings (e.g., ball bushings) are disposed in the openings 144 to enable the guide 132 to slide smoothly along the linear guide tracks 142. In some examples, the guide 132 is driven along the linear guide tracks 142 via a drive screw, as discussed in further detail herein. In the illustrated example, the level wind apparatus 130 includes three linear guide tracks 142. However, in other examples, the level wind apparatus 130 may include more (e.g., four, five, etc.) or fewer (e.g., two, one) linear guide tracks.

In the illustrated example, the reel 104 has a substantially smooth outer surface 145. As such, unlike known string reels that have grooved reels, the example string reel 100 can be used with different diameter lines. For example, the string reel 100 may be used with a line having a diameter of 0.25 inches (in) (6.35 millimeters (mm)) or a line having a diameter of 0.75 in (19.05 mm). In other examples, the diameter of the line may be larger or smaller. The guide 132 moves along the reel 104 as the reel 104 is rotated to distribute the line 102 along the reel 104, thereby keeping the line 102 uniformly wound and free from tangling and jamming the unit.

In the illustrated example of FIGS. 1 and 2, the guide 132 is positioned to direct the line 102 in a substantially horizontal direction. In some examples, the level wind apparatus 130 may be moved to reposition the guide 132 and, thus, direct the line 102 in other directions. In particular, the level wind apparatus 130 (and, thus, the guide 132) may be moved around the circumference (e.g., along a parallel circumference) of the reel 104 to redirect the line 102. For example, in FIG. 1, the first support plate 110 includes a plurality of positioning holes 146 (one of which is referenced in FIG. 1), and the first end plate 138 includes a plurality of alignment holes 148 (one of which is referenced in FIG. 1). One or more of the alignment holes 148 may be aligned with one or more of the positioning holes 146. A pin or bolt may be inserted into one or more of the alignment hole(s) 148 and into the corresponding positioning hole(s) 146 to hold the first end plate 138 in position. In the illustrated example, the positioning holes 146 are spaced apart from each and arranged in an arc along the circumference of the reel 104. As such, the level wind apparatus 130 can be moved from one position (e.g., the horizontal position shown in FIG. 1) to another position (e.g., a position in which the line 102 is directed substantially vertical) to change the direction of the line 102. While in the illustrated example the first end plate 138 includes five alignment holes 148, in other examples, the first end plate 138 may include more (e.g., six, seven, etc.) or fewer (e.g., four, three, etc.) alignment holes. In some examples, the second support plate 112 also includes a plurality of positioning holes. For example, referring to FIG. 2, the second support plate 112 includes a plurality of positioning holes 202 (one of which is referenced in FIG. 2), and the second end plate 140 includes a plurality of alignment holes 204 (one of which is referenced in FIG. 2) that may be aligned with one or more of the positioning holes 202. A pin or bolt may be inserted into one or more of the alignment hole(s) 204 and into the corresponding positioning hole(s) 202 to hold the second end plate 140 in position. Further, in addition to directing the line 102 onto the reel 104 in vertical or horizontal direction (or any angle therebetween), the example string reel 100 can also accommodate lateral loads because the guide 132 redirects the line 102 back onto or away from the reel 104 in a substantially straight direction.

Referring back to FIG. 1, the example level wind apparatus 130 includes a drive screw 150 to move the guide 132 back-and-forth along the linear guide tracks 142. In the illustrated example, the drive screw 150 is rotatably coupled between the first and second end plates 138, 140 and extends through a threaded opening 152 in the guide 132. When the drive screw 150 rotates, the guide 132 is driven in one direction or the other along the drive screw 150.

Figure 3:
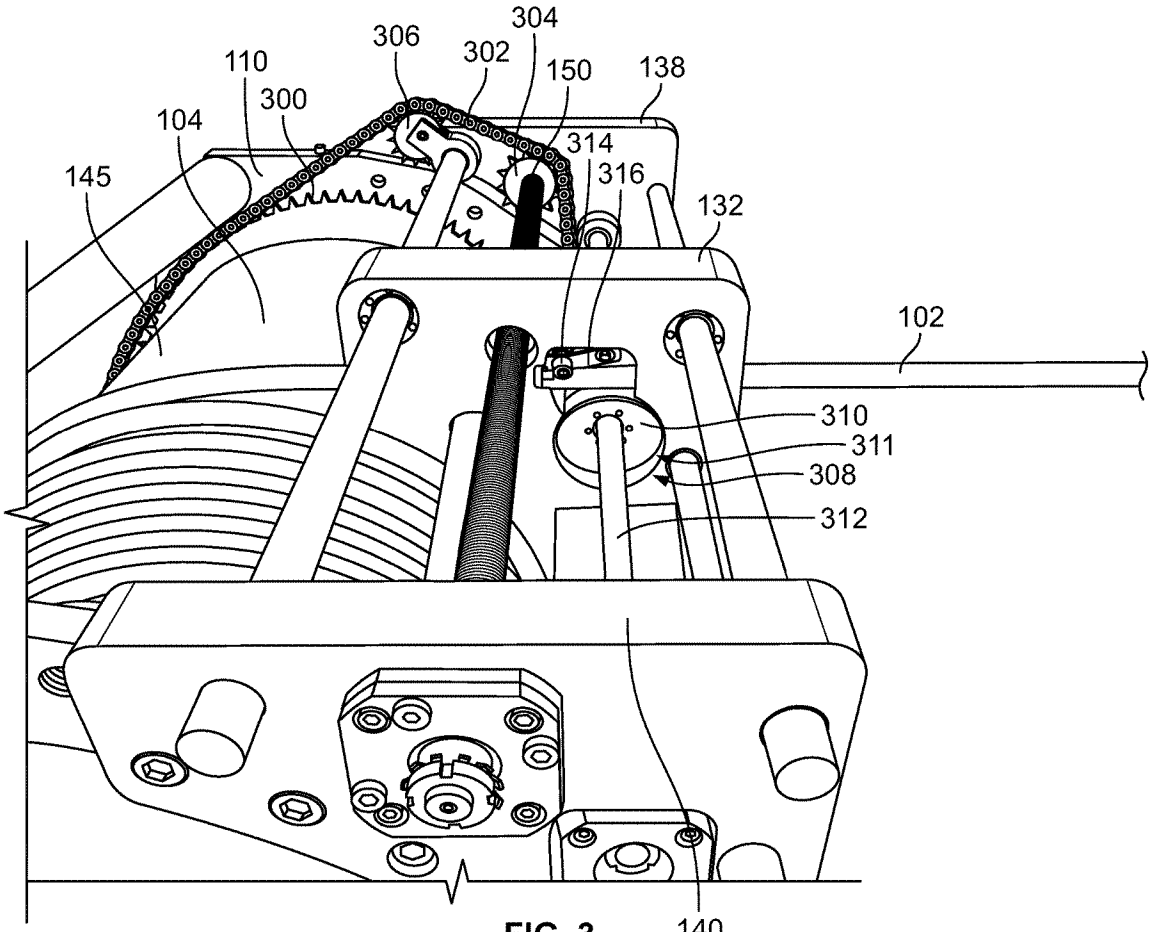
FIG. 3 is another perspective view of the example string reel of FIG. 1.

In some examples, the guide 132 is driven in unison with the reel 104. For example, as illustrated in FIG. 3, the reel 104 includes teeth 300 around the outer surface 145 of the reel 104 near the first support plate 110. The teeth 300 drive a chain 302, which is engaged with a sprocket 304 coupled to the end of the drive screw 150 near the first end plate 138. Therefore, as the reel 104 rotates in one direction, the drive screw 150 is rotated in the same direction and the guide 132 is driven in one linear direction along the length of the reel 104. Likewise, as the reel 104 is rotated in the opposite direction, the drive screw 150 is rotated in same direction and the guide 132 is transferred in the other linear direction along the length of the reel 104. As such, when winding the line 102 onto the reel 104, the guide 132 moves in one direction, and when unwinding the line 102 from the reel 104, the guide 132 moves in the other direction. In the illustrated example, a tensioner sprocket 306 is coupled to the first end plate 138 and maintains tension on the chain 302.

In some examples, the thread on the drive screw 150 is designed to move the guide 132 a predetermined amount with every rotation of the reel 104. As such, the guide 132 evenly distributes the line 102 across the reel 104 with a substantially consistent spacing between each turn or loop of the line 102. For example, for one rotation of the reel 104, the guide 132 may move 0.75 in (19.05 mm) along the drive screw 150. If the line 102 has a diameter of 0.625 in (15.875 mm), for example, then the guide 132 creates a gap of 0.0625 in (1.5875 mm) on each side of the line 102. In other examples, the line may have a smaller or larger diameter. In some examples, leaving a gap on each side of the line 102 prevents the line 102 from rubbing on itself and, thus, fraying of the line 102. In other examples, the pitch of the thread on the drive screw 150 may be larger or smaller depending on the desired distanced to be traveled with every rotation.

Figure 4A:
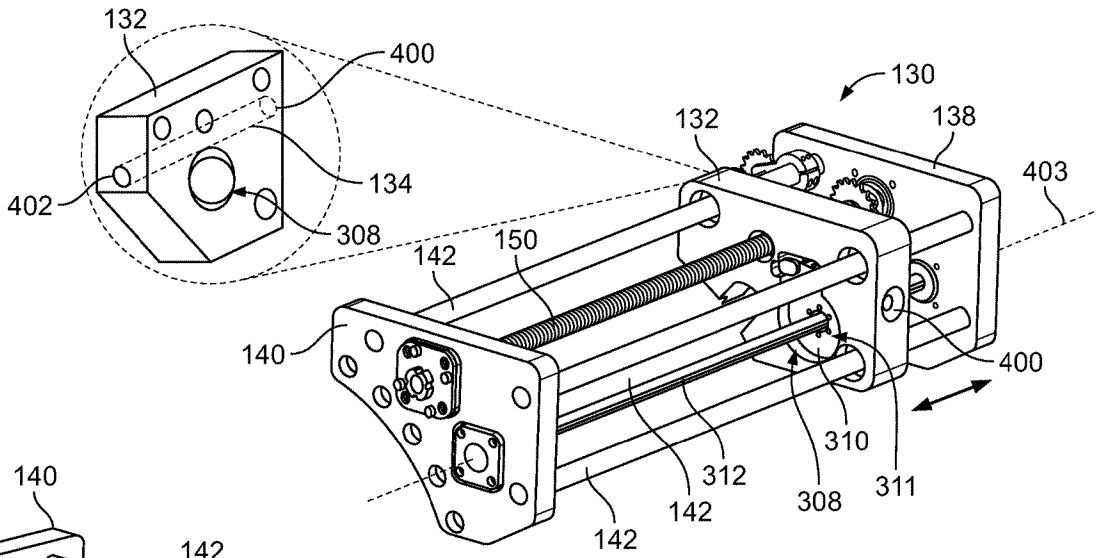
FIGS. 4A and 4B are perspective views of an example level wind apparatus implemented by the example string reel of FIG. 1.
Figure 4B:
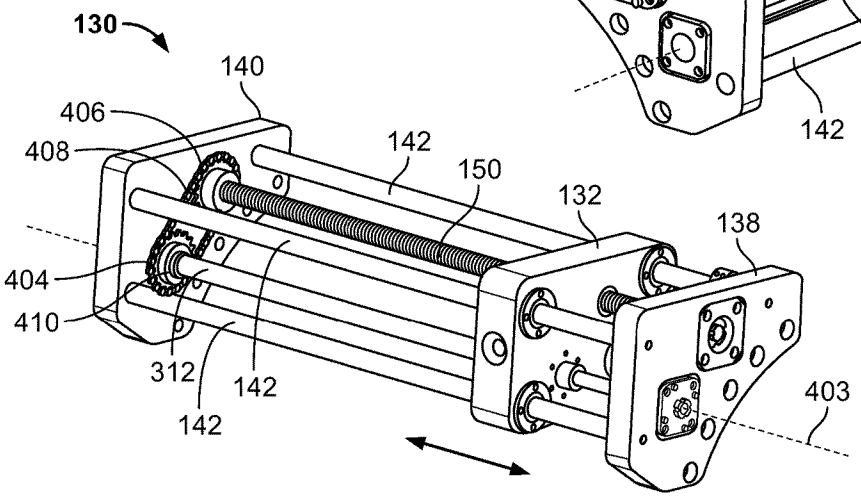

FIGS. 4A and 4B are perspective views of the example level wind apparatus 130. As mentioned above, the guide 132 of the level wind apparatus 130 is movable along the linear guide tracks 142 between the first and second end plates 138, 140. The guide 132 is driven by the drive screw 150. When the drive screw 150 is rotated in one direction, the guide 132 moves in one linear direction along the length of the reel 104 (FIG. 1), and when the drive screw 150 is rotated in the opposite direction, the guide 132 moves in the opposite linear direction along the length of the reel 104. The line 102 (FIG. 1) passes through the passageway 134 in the guide 132. The side of the guide 132 facing the reel 104 (FIG. 1) is depicted in the callout in FIG. 4A, which shows the passageway 134 in dashed lines. As illustrated in FIG. 4A, the passageway 134 extends between a first eyelet 400 on one side of the guide 132 and a second eyelet 402 on the other side of the guide 132.

As illustrated in FIGS. 3 and 4A, the example level wind apparatus 130 includes a tensioner 308 to keep tension on the line 102 when unwinding the line 102 from the reel 104. The tensioner 308 creates a tension in the line 102 between the reel 104 and the tensioner 308 that prevents the line 102 from excessive slack and/or otherwise gathering between the guide 132 and the reel 104 and causing a jam or jumping a sheave. In the illustrated example, the tensioner 308 is disposed in the guide 132 between the first eyelet 400 and the second eyelet 402. However, in other examples, the tensioner 308 may be disposed in other locations (e.g., outside of the first eyelet 400).

In the illustrated example of FIGS. 3 and 4A, the tensioner 308 includes a friction wheel 310. The friction wheel 310 is disposed within an opening 311 in the guide 132. The passageway 134 (FIG. 4A) passes over one side of the friction wheel 310 such that the line 102 engages the friction wheel 310. In the illustrated example, the friction wheel 310 has a v-shaped or u-shaped groove on which the line 102 rides, which enables the friction wheel 310 to accommodate different diameter lines. When the line 102 is to be unwound from the reel 104, the friction wheel 310 is rotated in the same direction as the reel 104, which pulls the line 102 outward away from the reel 104, thereby creating tension in the line 102. However, when the line 102 is be retracted or wound around the reel 104, the friction wheel 310 spins freely (e.g., freewheels) or remains stationary and the line 102 may slide over the friction wheel 310, thereby allowing the line 102 to be retracted without additional force on the line 102. In known string reels that do not include such a tensioner 308, the line may droop and accumulate between the reel and the guide mechanism when unwinding the line. The line may become tangled, snagged and/or otherwise interfere with the other parts of the string reel. As such, the example string reel 100 achieves better results because it prevents slack in the line 102 when unwinding the line 102.

In the illustrated example of FIGS. 3, 4A and 4B, the friction wheel 310 is coupled to a drive shaft 312 that extends between the first and second end plates 138, 140. The friction wheel 310 is rotatable with the drive shaft 312 and slidable along the drive shaft 312. As illustrated in FIGS. 4A and 4B, the drive shaft 312 and the friction wheel 310 are rotatable about an axis 403, which is parallel to the rotational axis 106 (FIG. 1) of the reel 104. In some examples, the drive shaft 312 is splined and the friction wheel 310 includes ball bearings that form a rotary ball spline with the drive shaft 312. Thus, the friction wheel 310 may rotated with the drive shaft 312 and smoothly slide along the drive shaft 312 as the guide 132 moves back-and-forth. To rotate the drive shaft 312 (and, thus, the friction wheel 310), a sprocket 404 is coupled to the drive shaft 312 near the second end plate 140, as illustrated in FIG. 4B. Additionally, as illustrated in FIG. 4B, another sprocket 406 is coupled to the drive screw 150 near the second end plate 140. The sprockets 404, 406 are coupled via a chain 408. As the drive screw 150 rotates, the sprocket 406 rotates the sprocket 404, which rotates the drive shaft 312 and, thus, rotates the friction wheel 310 (FIGS. 3 and 4A). In the other examples, the sprockets 404, 406 may be disposed in other locations and/or the drive shaft 312 may be rotated in other manners (e.g., via a separate motor).

To drive the friction wheel 310 when pulling out line 102 and freewheel the friction wheel 310 when retracting the line 102, the example level wind apparatus 130 includes a clutch 410, as illustrated in FIG. 4B. The clutch 410 is disposed between the sprocket 404 and the drive shaft 312. Thus, the friction wheel 310 is coupled to the clutch 410 via the drive shaft 312. In some examples, the clutch 410 is implemented as a no-back or one-way roller clutch, such as a sprag clutch or needle bearing clutch. When the reel 104 is rotated in the direction to unwind the line 102, the clutch 410 is engaged, and the sprocket 404 drives the drive shaft 312. As a result, the friction wheel 310 is rotated and pulls the line 102 outward. In some examples, the friction wheel 310 is rotated at a faster speed than the reel 104 when unwinding the line 102. In other words, the surface speed of the friction wheel 310 is faster than the surface speed of the reel 104. As a result, tension is created in the line 102 between the reel 104 and the friction wheel 310 that prevents slack from accumulating between the reel 104 and the guide 132. In some examples, the sprockets 404, 406 are sized to rotate the drive shaft 312 (and, thus, the friction wheel 310) faster than the reel 104.

When the reel 104 is rotated in the opposite direction to wind the line 102 back onto the reel 104, the clutch 410 is disengaged and the sprocket 404 spins freely from the drive shaft 312. Thus, the friction wheel 310 may be rotated in the reverse direction via friction from the line 102 or the line 102 may slide over the friction wheel 310. In some examples, a tension wheel 314 is provided to bias the line 102 against the friction wheel 310. For example, as illustrated in FIG. 3, the tension wheel 314 (e.g., a second wheel) is disposed above the line 102 and biases the line 102 downward into the friction wheel 310 (e.g., a first wheel). In the illustrated example, the tension wheel 314 is biased downward via a spring-loaded arm 316. In some examples, the tension wheel 314 has a reverse v-shaped or u-shaped surface to accommodate different sized lines. While in the illustrated example the clutch 410 is implemented between the sprocket 404 and the drive shaft 312, in other examples, the clutch 410 may be disposed in other locations of the drive train. For example, the clutch 410 may be disposed between drive shaft 312 and the friction wheel 310.

Figure 5:
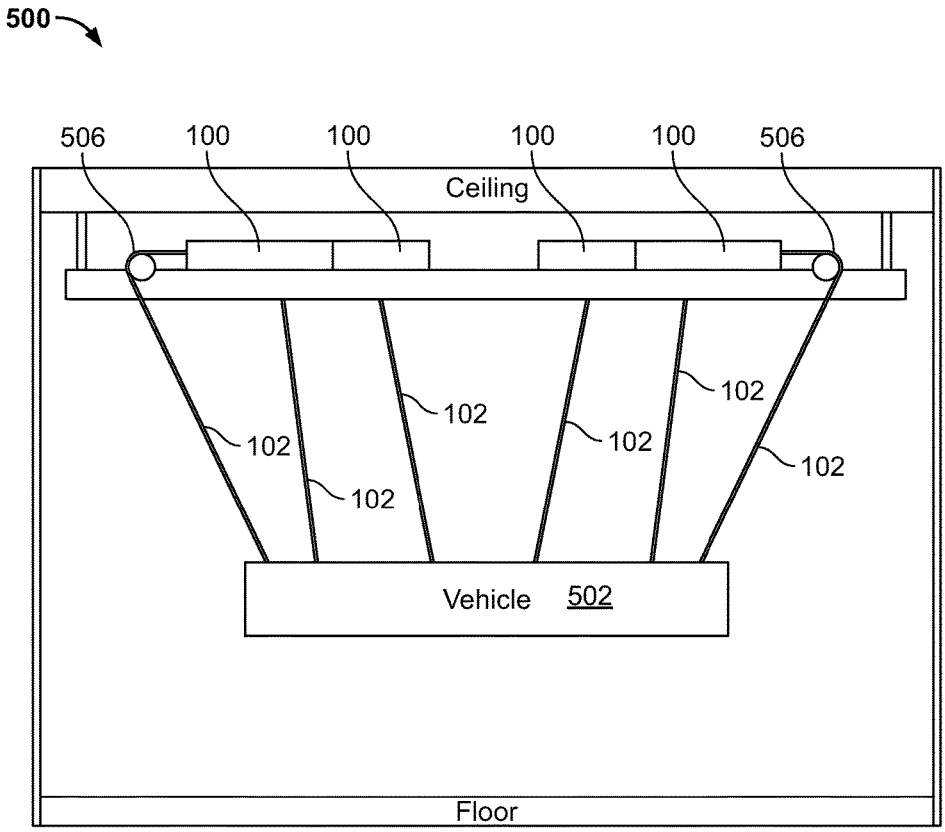
FIG. 5 illustrates an example hoist system utilizing multiple example string reels to lift an example vehicle.

As mentioned above, the example string reel 100 of FIG. 1 may be used to lift an object of interest. In some examples, one or more multiple string reels 100 are used in a system to hoist an object. FIG. 5 illustrates an example hoist system 500 utilizing multiple string reels 100 to lift a vehicle 502 off of the floor. The vehicle 502 may be a land-based vehicle (e.g., a car), an aircraft, a boat, and/or any other object to be lifted off of the ground. The hoist system 500 may be used to lift a car, for example, in a wind tunnel for aerodynamic testing. In other examples, the system 500 may be used to lift the vehicle 502 for manufacturing purposes and/or for servicing purposes.

In the illustrated example, multiple string reels 100 are coupled to a turn table 504 attached to the ceiling. The line 102 of each string reel 100 is directed downward via a pulley 506 (two of which are referenced in FIG. 5). The lines 102 may be coupled to various locations on the vehicle 502. The string reels 100 may be operated independently and/or simultaneously to move the vehicle 502 to any desired orientation. In some examples, the turn table 504 is rotatable, such that after the vehicle 502 is lifted, the vehicle 502 can be rotated to other positions.

Figure 6:
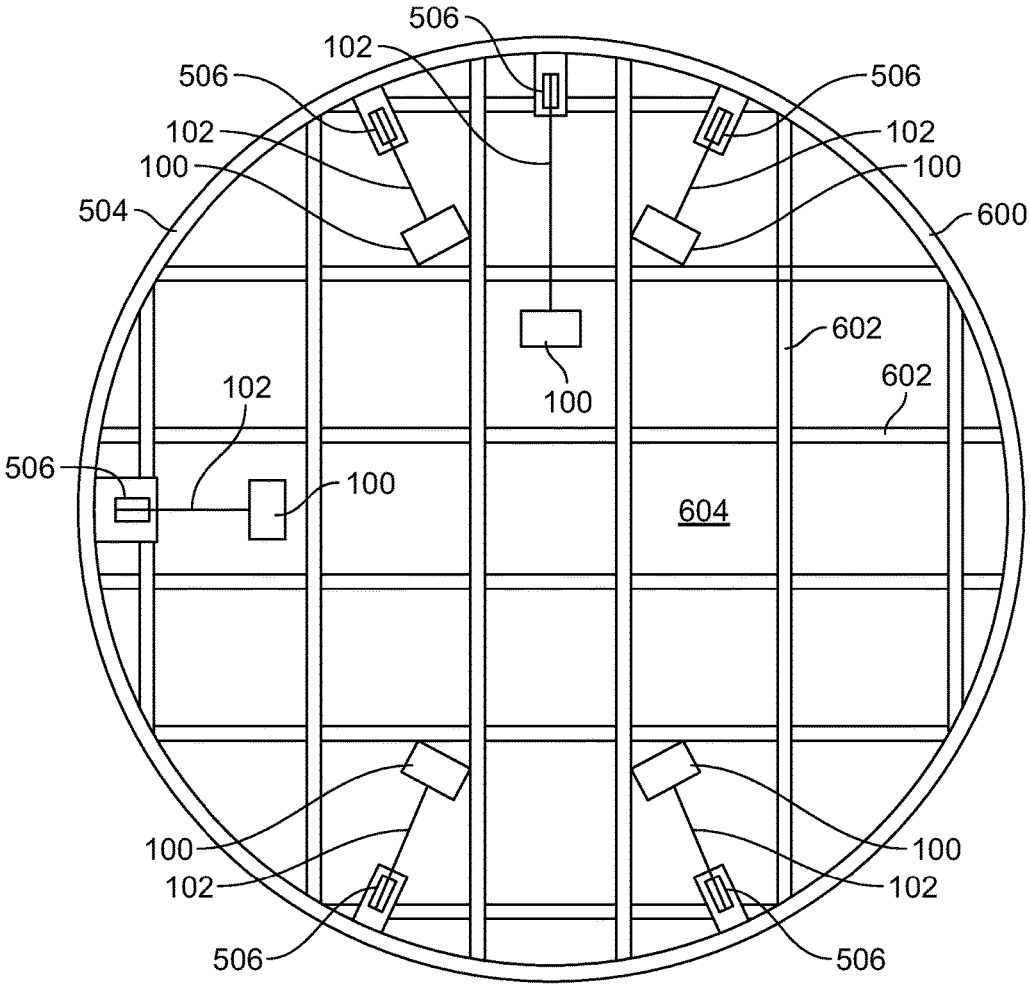
FIG. 6 is a plan view of an example turn table on which the example string reels may be arranged.

FIG. 6 illustrates an example plan view of the example turn table 504. In the illustrated example, the turn table 504 includes a circular support 600 and a plurality of cross supports 602 (e.g., rafters, trusts, etc.) that carry a surface 604 (e.g., a ceiling). The string reels 100 may be coupled to the surface 604 and/or the supports 600, 602 and positioned in any location. The lines 102 are directed downward via the respective pulleys 606. The string reels 100 may be rotated about their vertical axes (e.g., the axis 118 of FIG. 1) to point the lines 102 in other directions depending on the desired configuration. In the illustrated example, six string reels 100 are used. However, in other example, the turn table 504 may include more (e.g., seven, eight, etc.) or fewer (e.g., five, four, etc.) string reels 100.

From the foregoing, it will be appreciated that the above disclosed string reels include level wind apparatus with tensioners that reduce or eliminate slack buildup when delivering or unwinding the line. Thus, the example string reels are less likely to be jammed and damaged compared to known string reels. Additionally, some example level wind apparatus disclosed herein can be moved to change the direction in which the line is fed onto or away from the reel. Thus, the direction of the line can be changed without have to reorient the entire string reel. Further, some example string reels disclosed herein include reels that are substantially smooth and do not have grooves. Thus, the example reels can be used with different diameter lines and, thus, are useful in more applications than known string reels having grooves that can accommodate only one diameter line. For example, a smaller line may be used to lift a lighter object, and the smaller line may be replaced with a larger line to lift a heavier object. While the example string reels discussed herein are disclosed in connection with moving (e.g., lifting) an object (e.g., the vehicle 502 of FIG. 5), the example string reels may also be used to store the line, such as for storing a rope.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A level wind apparatus comprising:

a first end plate;

a second end plate;

a track disposed between the first end plate and the second end plate;

a guide slidable along the track to direct a line onto or away from a reel when the reel is rotating, wherein the reel is rotatable in a first direction to wind the line onto the reel and the reel is rotatable in a second direction to unwind the line from the reel;

a tensioner including a friction wheel to create tension in the line while the reel is rotating the second direction;

a drive shaft extending between the first end plate and the second end plate, the friction wheel rotatable with the drive shaft and slidable along the drive shaft;

a sprocket disposed near the second end plate; and a clutch disposed between an end of the drive shaft and the sprocket near the second end plate, the clutch to drive the drive shaft and the friction wheel when the reel is rotated in the second direction, and the clutch to freewheel the drive shaft and the friction wheel when the reel is rotated in the first direction.

2. The level wind apparatus of claim 1, wherein the friction wheel is to be driven at a faster speed than the reel when the reel is rotating in the second direction.

3. The level wind apparatus of claim 1, wherein the tensioner includes a tension wheel to bias the line against the friction wheel.

4. The level wind apparatus of claim 3, further including a spring-loaded arm to bias the tension wheel toward the line.

5. The level wind apparatus of claim 1, wherein the clutch is a one-way sprag clutch.

6. The level wind apparatus of claim 1, wherein the friction wheel has a v-shaped groove.

7. The level wind apparatus of claim 1, further including a drive screw disposed between the first end plate and the second end plate, the drive screw extending through a threaded opening in the guide, wherein the drive screw is rotatable to drive the guide along the track.

8. The level wind apparatus of claim 7, wherein the sprocket is a first sprocket, further including a second sprocket coupled to the drive screw, the second sprocket to be driven by a first chain coupled to the reel.

9. The level wind apparatus of claim 8, wherein the second sprocket is coupled to an end of the drive screw near the first end plate, further including a third sprocket coupled to an end of the drive screw near the second end plate.

10. The level wind apparatus of claim 9, further including a second chain between the first sprocket and the third sprocket, the third sprocket to drive the first sprocket via the second chain.

11. The level wind apparatus of claim 1, wherein the guide has a passageway between a first eyelet and a second eyelet, the line to pass through the passageway, the tensioner disposed in the guide between the first eyelet and the second eyelet.

12. A string reel comprising:

a reel rotatable in a first direction to wind a line onto the reel and rotatable in a second direction to unwind the line from the reel; and a level wind apparatus to direct the line onto or away from the reel when the reel is rotating, the level wind apparatus movable along a circumference of the reel from a first position to a second position, the level wind apparatus including:

a first end plate;

a second end plate;

a track disposed between the first end plate and the second end plate;

a guide slidable along the track to direct the line onto or away from the reel when the reel is rotating;

a tensioner including a friction wheel to create tension in the line while the reel is rotating the second direction;

a drive shaft extending between the first end plate and the second end plate, the friction wheel rotatable with the drive shaft and slidable along the drive shaft;

a sprocket disposed near the second end plate; and a clutch disposed between an end of the drive shaft and the sprocket near the second end plate, the clutch to drive the drive shaft and the friction wheel when the reel is rotated in the second direction, and the clutch to freewheel the drive shaft and the friction wheel when the reel is rotated in the first direction.

13. The string reel of claim 12, further including a first support plate and a second support plate, the reel rotatably coupled between the first and second support plates, and wherein the first end plate is coupled to the first support plate and the second end plate is coupled to the second support plate.

14. The string reel of claim 13, wherein the first support plate includes a plurality of positioning holes spaced apart from each other and arranged along an arc, the first end plate movable along the plurality of positioning holes to move the level wind apparatus from the first position to the second position.

15. The string reel of claim 14, wherein the first end plate includes a plurality of alignment holes to align with one or more of the plurality of positioning holes.

16. The string reel of claim 12, wherein the reel is substantially smooth.

17. A string reel comprising:

a reel around which a line is to be wound and unwound, the reel rotatable about a first axis, the reel rotatable in a first direction to wind the line onto the reel and rotatable in a second direction to unwind the line from the reel; and a level wind apparatus including:

a first end plate;

a second end plate;

a track disposed between the first end plate and the second end plate;

a guide slidable along the track to direct the line onto or away from the reel when the reel is rotating, a tensioner including a friction wheel disposed adjacent the reel, the friction wheel rotatable about a second axis parallel to the first axis, the line engaged with the friction wheel, the friction wheel to rotate in a same direction as the reel when unwinding the line to cause a tension in the line between the reel and the friction wheel;

a drive shaft extending between the first end plate and the second end plate, the friction wheel rotatable with the drive shaft and slidable along the drive shaft;

a sprocket disposed near the second end plate; and a clutch disposed between an end of the drive shaft and the sprocket near the second end plate, the clutch to drive the drive shaft and the friction wheel when the reel is rotated in the second direction, and the clutch to freewheel the drive shaft and the friction wheel when the reel is rotated in the first direction.

18. The string reel of claim 17, wherein the guide has a passageway to direct the line onto or away from the reel, the friction wheel disposed within the guide.

19. The string reel of claim 17, further including a tension wheel to bias the line into the friction wheel.

* * * * *